US005261173A

United States Patent [19]

Brobeck

[11] Patent Number: 5,261,173

[45] Date of Patent: Nov. 16, 1993

[54] AUTOMATIC CALENDAR

[76] Inventor: William M. Brobeck, 120 Sleepy Hollow La., Orinda, Calif. 94563

[21] Appl. No.: 291

[22] Filed: Jan. 4, 1993

[51] Int. Cl.[5] ..... G09D 3/00

[52] U.S. Cl. ..... 40/110; 40/117; 40/107; 283/2; 283/3; 283/4

[58] Field of Search ..... 40/110, 117, 107; 283/2, 3, 4; 368/28, 40

[56] References Cited

U.S. PATENT DOCUMENTS

| | | | |
|---|---|---|---|
| 370,364 | 9/1887 | Wood | 40/110 |
| 1,196,679 | 8/1916 | Gutekunst | 40/110 |
| 1,840,179 | 1/1932 | White et al. | 40/110 |
| 2,509,121 | 5/1950 | Wesseler | 40/117 |
| 3,609,896 | 10/1971 | Hussar | 40/117 |
| 4,646,453 | 3/1987 | Reinhart | 40/117 |

*Primary Examiner*—Clifford D. Crowder
*Assistant Examiner*—Gloria Hale
*Attorney, Agent, or Firm*—James F. Mitchell

[57] ABSTRACT

An automatic calendar comprising a first scroll intermittently movable in a vertical direction and carrying a multiple month display of consecutive calendar days arranged in weeks disposed transversely with respect to its direction of travel; a second transparent scroll intermittently movable orthogonally with respect to the first scroll and having a current day indicator with which to identify the current calendar day carried on the first scroll; and drive and timing means to move the first scroll vertically in weekly intervals coordinated with motion of the second scroll to move the day indicator intermittently in daily intervals from left to right so as to identify in sequence the current calendar day carried on the first scroll.

4 Claims, 2 Drawing Sheets

AUTOMATIC CALENDAR

BACKGROUND OF THE INVENTION

Over the years a number of automatic calendars have been described in the patent art including U.S. Pat. Nos. to O'Brien 13,593 for perpetual Calendar; Coppedge 1,235,442 for Advertising Calendar; Cook 1,310,905 for Calendar; Oppenheim 1,415,686 for Calendar; Vivian 1,432,504 for Perpetual Calendar; Fenimore 1,788,511 for Perpetual Calendar; Prince 2,069,390 for Clock Actuated Display Mechanism; Padgett 2,790,411 for Multiple Band Frequency Indicator for Radio Apparatus; Sink 2,837,850 for Electric Calendar; Ryan 2,841,900 for Multi-Year Calendar; Rogers 3,316,668 for Adjustable Garden Chart; and Kuei-Wen 4,694,597 for Electric Perpetual Calendar.

A number of these prior art patents disclose continuous tapes or scrolls containing monthly or perpetual calendars that are moved in time to display the proper set of calendar days of the week or all days of the current month. However, none of the art seems to describe a calendar where several months are visible at one time and the current day is marked in distinguishing fashion from other days of a current week or month.

SUMMARY OF THE INVENTION

This invention includes an automatically timed display of the current calendar month and all or portions of the preceding and succeeding months displayed on a first vertically stepped scroll with the current day indicated by a frame or other indicator carried on a second orthogonally movable transparent scroll stepped in timed relation to the first scroll in order to indicate the current day of a week carried on the first scroll.

DESCRIPTION OF PREFERRED EMBODIMENT OF THE INVENTION

The automatic calendar of this invention comprises a first scroll 1 carrying a numerical display of consecutive calendar days 2 arranged in calendar weeks transversely across the scroll. This first scroll is intermittently stepped in a vertical direction 3 shown as upwardly in FIG. 1. The first scroll displays not only the days of the current calendar month but, also, calendar days of the previous and succeeding months, such as January, February and March, shown in FIG. 1.

Figure 1:
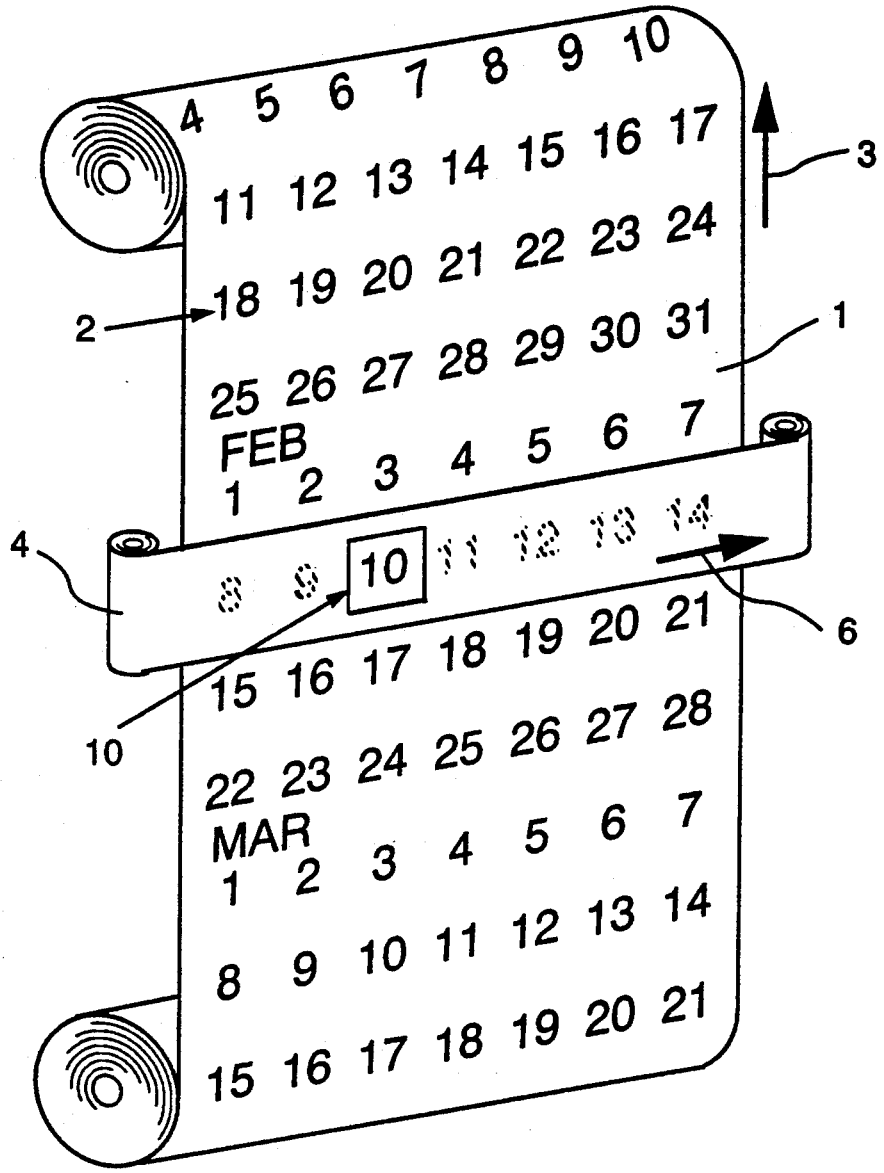
FIG. 1 schematically illustrates the orthogonally disposed scrolls carrying consecutive calendar days and a current day indicator, respectively.

A second intermittently stepped scroll 4 is disposed orthogonally with respect to the first scroll 1 and intermittently moves from left to right as shown in FIG. 1 to indicate the current calendar day. This second scroll 4 is transparent and carries an indicator 5 which frames the current calendar day (February 10) on the first scroll. As shown, the transparent second scroll 4 permits one to view the preceding and succeeding days of the week as well. As indicated at 6 the second scroll 4 steps from left to right at daily intervals to indicate the current calendar day. At the end of each calendar week the direction of travel of second scroll 4 is reversed to retract the day indicator 5 from right to left and to place it over the first day of the following week. In sequence, the first scroll 1 advances a step to display that following week along the path of travel for the second scroll.

Figure 2:
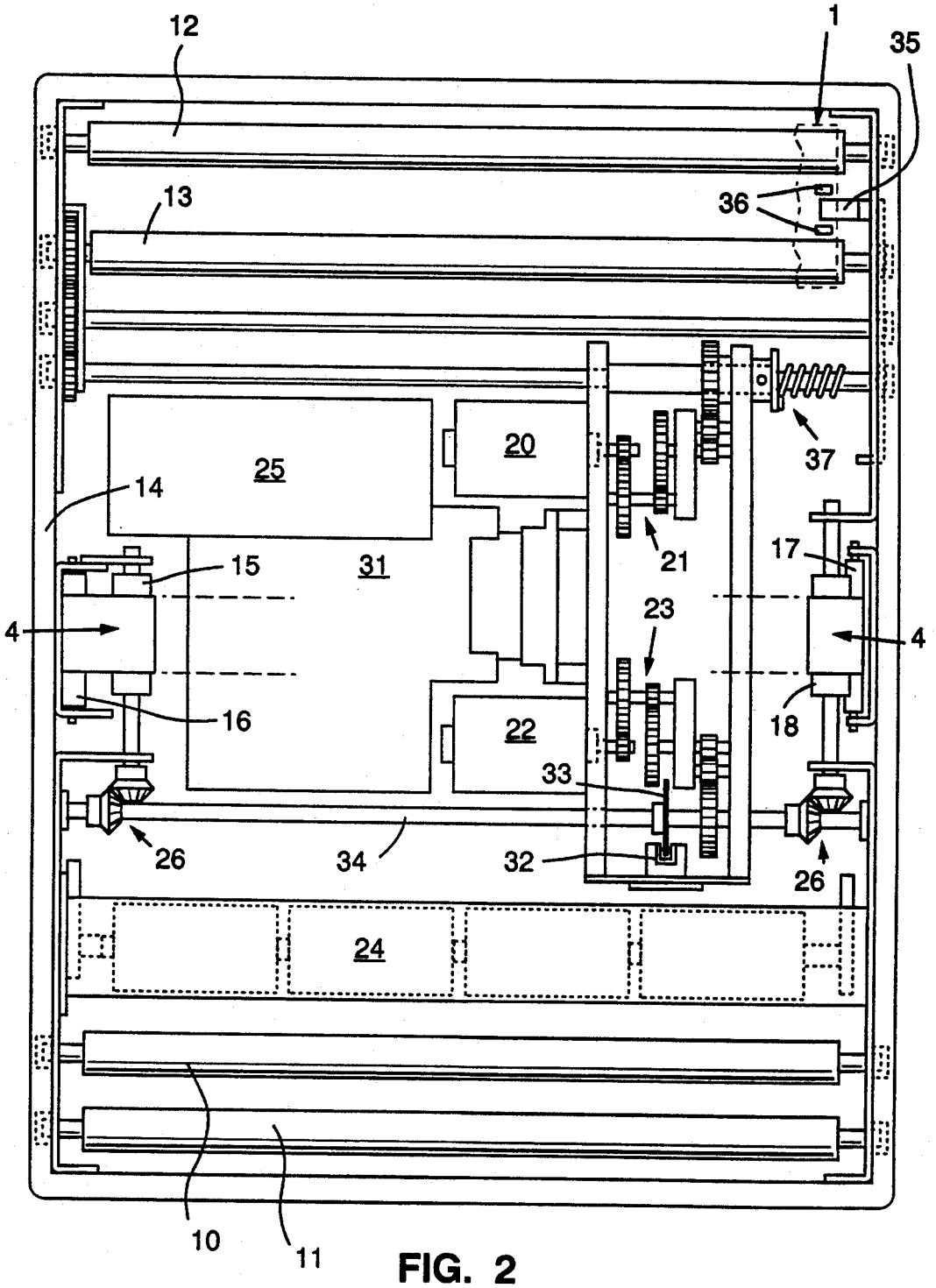
FIG. 2 is a rear view of one useful calendar scroll mechanical drive for stepping the scrolls of FIG. 1 in timed relationship.

FIG. 2 illustrates one mechanical drive that is useful in coordinating the scroll motions. The first scroll 1, shown partially in FIG. 2, is unwound from a first delivery roll 10 over a first idler guide roll 11, upwardly and then over a second idler guide roll 12 onto a take-up roll 13. These rolls are rotatably mounted upon a calendar frame 14 shown in FIG. 2, which is a rear view of the calendar structure. The second scroll 4 is unwound from a first delivery roll 15 over first idler guide roll 16 and a second idler guide roll 17 onto take-up roll 18, also mounted from the calendar frame 14. In FIG. 2, being a rear view of the calendar, the second scroll steps to move the day indicator 5 from a position adjacent to roll 18 toward roll 15 for indicating the current calendar day. After reaching the last day of the calendar week, that motion is reversed to move the indicator 5, then adjacent to roll 15, back to its starting location adjacent roll 18. The illustrated indicator 5 is a frame which may be brightly colored to outline the numeral for the current day.

A first DC scroll motor 20 through reduction gear train 21 drives take-up roll 13 for the first scroll 1 to wind that scroll upon it in weekly stepped intervals. A second DC scroll motor 22 drives rolls 15 and 18 for the second scroll 4 through reduction gear train 23 and bevel gears 26 to advance the day indicator 5 from left to right and to retract the day indicator from right to left upon reaching a point just beyond the last day of each week. Both motors are supplied by batteries 24 with power only at the time the scrolls move.

The timing of the stepped scroll motion is controlled by a clock 25, preferably operated by its own battery supply, which sends a signal to the drive mechanism every twenty-four hours such as at midnight of each day. An electronic motor control 31, for example, advances the day indicator 5 on the second scroll once every twenty-four hours. The position of indicator 5 in a week is sensed by a first day position photosensor 32, which in combination with a light interrupting disc 33, indicates every turn or half-turn of drive shaft 34 for the second scroll 4 to position indicator 5 over a calendar day. The end positions of indicator travel are sensed by end position photosensors, not shown, to sense the position of the day indicator 5 at the end of a week first, to reverse the direction of travel for the second scroll at the end of a week and then to initiate the direction of travel from right to left at the beginning of each week.

A fourth photosensor 35 senses and stops motion of the first scroll 1 after moving to a succeeding week by detecting opaque marks 36 carried upon the edge of that scroll. The calendar on the first scroll also may be positioned manually to correspond to the actual calendar week by a clutch means 37 which disengages its motor drive. The day indicator 5 on the second scroll also may be stepped repetitively at less than twenty-four hour intervals to locate it upon the current calendar day. Retraction of the day indicator at week-end also occurs in relation to first scroll motion to reset its position to the first day of the following week.

What is claimed is:

1. An automatic calendar comprising a first scroll intermittently movable in a first direction and carrying a multiple month display of consecutive calendar days arranged in weeks disposed transversely with respect to the direction of travel of said first scroll;

a second transparent scroll intermittently movable orthogonally with respect to and in front of said first scroll and having a current day indicator with which to identify the current calendar day carried on the first scroll;

first drive means to move said first scroll intermittently in weekly intervals coordinated with the motion of said second scroll;

second drive means for said second scroll to move the current day indicator intermittently in daily intervals so as to identify in sequence each current calendar day carried on said first scroll;

and timing means to initiate said first drive means upon completion of the travel of the day indicator of said second scroll across said second scroll and to initiate retraction of said second scroll so as to place its current day indicator over the first day of the subsequent week.

2. The automatic calendar of claim 1 wherein said first scroll travels vertically and said second scroll travels in daily intervals from left to right.

3. The automatic calendar of claim 1 wherein the first and second drive means include battery powered DC motors energized only at the time of scroll motion.

4. The automatic calendar of claim 1 wherein the first and second drive means include spaced take-up and delivery rolls upon which said scrolls are respectively wound.

* * * * *